US008763598B1

(12) United States Patent
MacLeod

(10) Patent No.: US 8,763,598 B1
(45) Date of Patent: Jul. 1, 2014

(54) CROSSBOW SETTING DEVICE

(76) Inventor: Russell D. MacLeod, Thunder Bay (CA)

( * ) Notice: Subject to any disclaimer, the term of this patent is extended or adjusted under 35 U.S.C. 154(b) by 428 days.

(21) Appl. No.: 13/350,317

(22) Filed: Jan. 13, 2012

(51) Int. Cl.
*F41B 5/18* (2006.01)
*F41B 5/12* (2006.01)
*F41B 5/14* (2006.01)

(52) U.S. Cl.
CPC ..... *F41B 5/1469* (2013.01); *F41B 5/12* (2013.01); *F41B 5/14* (2013.01)
USPC ..... 124/86; 124/1; 124/25; 124/88; 124/90

(58) Field of Classification Search
CPC ..... F41B 5/1469; F41B 5/12; F41B 5/14
USPC ..... 124/1, 25, 86, 88, 90
See application file for complete search history.

(56) References Cited

U.S. PATENT DOCUMENTS 3,538,901 A * 11/1970 Switack ..... 124/25
4,474,296 A * 10/1984 Hartman ..... 211/85.7
4,603,676 A * 8/1986 Luoma ..... 124/25
4,827,894 A * 5/1989 Schallberger ..... 124/25
5,048,504 A * 9/1991 Ballard ..... 124/86
5,115,795 A * 5/1992 Farris ..... 124/86
5,243,956 A * 9/1993 Luehring ..... 124/86
5,243,957 A * 9/1993 Neilson ..... 124/88
5,749,348 A * 5/1998 Oviedo-Reyes ..... 124/25
5,823,172 A * 10/1998 Suggitt ..... 124/25
6,286,496 B1 * 9/2001 Bednar ..... 124/25
6,457,685 B1 * 10/2002 Taylor ..... 248/166
6,874,491 B2 * 4/2005 Bednar ..... 124/25
6,901,921 B1 * 6/2005 Barnett ..... 124/25
6,913,007 B2 * 7/2005 Bednar ..... 124/25
7,017,568 B1 * 3/2006 Smith ..... 124/25
7,100,590 B2 * 9/2006 Chang ..... 124/25
7,686,262 B2 * 3/2010 Pierce ..... 248/176.1
7,748,370 B1 * 7/2010 Choma ..... 124/25
8,342,495 B2 * 1/2013 Weissenborn ..... 269/101
8,375,928 B1 * 2/2013 Bednar et al. ..... 124/25
8,443,790 B2 * 5/2013 Pestrue ..... 124/25
8,453,632 B2 * 6/2013 Immesberger et al. ..... 124/35.2
8,573,192 B2 * 11/2013 Bednar et al. ..... 124/86
8,622,050 B2 * 1/2014 Goff et al. ..... 124/25
2006/0086346 A1 * 4/2006 Middleton ..... 124/25
2006/0169258 A1 * 8/2006 Chang ..... 124/25

* cited by examiner

*Primary Examiner* — Gene Kim
*Assistant Examiner* — Alexander Niconovich
(74) *Attorney, Agent, or Firm* — Jason L. Gilbert

(57) ABSTRACT

A crossbow setting device which assists with efficiently setting a crossbow into an armed position. The crossbow setting device generally includes a platform which includes a receiver aperture leading to a pathway extending inwardly from its front end. A locking member is slidably positioned within the receiver aperture so that it may traverse the pathway. A receiver opening comprised of a pair of slots is formed in an upper surface of the platform tangentially with respect to the pathway. By retracting the locking member, positioning the stirrup of a crossbow through the receiver opening and re-inserting the locking member, the crossbow may be locked into an upright position for use on-the-fly or to aid in setting the crossbow into an armed position.

20 Claims, 5 Drawing Sheets

CROSSBOW SETTING DEVICE

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a setting device for a crossbow and more specifically it relates to a crossbow setting device which assists with efficiently setting a crossbow into an armed position.

2. Description of the Related Art

Any discussion of the related art throughout the specification should in no way be considered as an admission that such related art is widely known or forms part of common general knowledge in the field.

Crossbows have been in use for hunting for many years. However, it can be exceedingly difficult to set a crossbow into an armed position with bare hands only. Many crossbows require in excess of 100 pounds of pulling force to set into an armed position which is not feasible for the many hunters.

Because of the strength needed to hand-cock a crossbow various devices have been offered to ease the process. A commonly used accessory to aid the setting of a crossbow into an armed position is a rope cocking aid. With such an aid, an individual places his or her foot into a stirrup and connects the rope cocking aid to both sides of the bow string which is placed over the stock portion of the bow for a mechanical advantage. However, even this solution requires a decent application of force. The main problem being a person's height or strength disabling them from getting the bow string to the locked position where their body would be in a straight up position, back straight, and cocking string pulled to waist height.

By inserting the stirrup into the locking device and then standing on top, the present invention provides a height advantage because the stirrup is now in a lower position allowing an operator of the present invention's power stroke to be elevated; allowing the operator to stand higher than the base of the stirrup. This also allows proper body mechanics which will prevent back injury or twisted ankle caused by being straight over the crossbow rather than off to the side pulling such a force. The platform height can also be raised up higher depending on the make of bow (room for adjustment/length of stirrup).

Because of the inherent problems with the related art, there is a need for a new and improved crossbow setting device which assists with efficiently setting a crossbow into an armed position.

BRIEF SUMMARY OF THE INVENTION

The invention generally relates to a crossbow setting device which includes a platform which includes a receiver aperture leading to a pathway extending inwardly from its front end. A locking member is slidably positioned within the receiver aperture so that it may traverse the pathway. A receiver opening comprised of a pair of slots is formed in an upper surface of the platform tangentially with respect to the pathway. By retracting the locking member, positioning the stirrup of a crossbow through the receiver opening and re-inserting the locking member, the crossbow may be locked into an upright position for use on-the-fly or to aid in setting the crossbow into an armed position.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
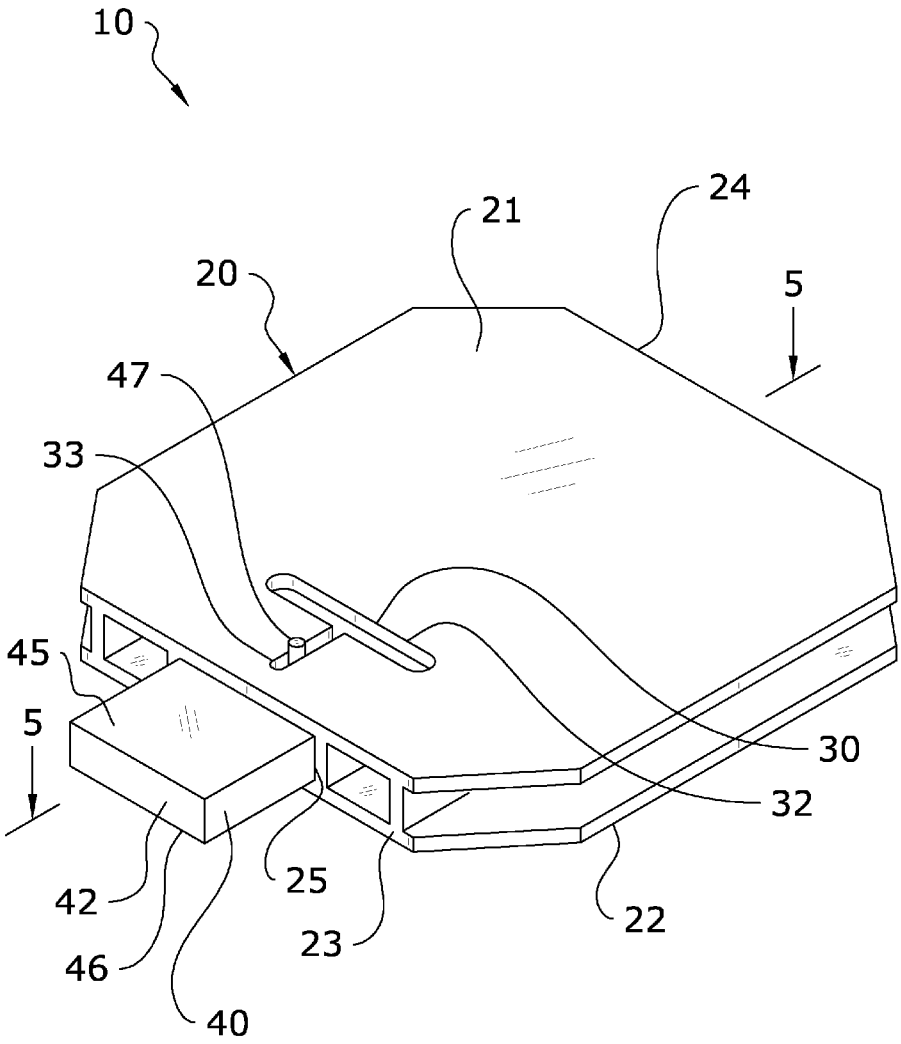
FIG. 1 is an upper perspective view of the present invention.

Turning now descriptively to the drawings, in which similar reference characters denote similar elements throughout the several views, FIGS. 1 through 5 illustrate a crossbow setting device 10, which comprises a platform 20 which includes a receiver aperture 25 leading to a pathway 26 extending inwardly from its front end 23. A locking member 40 is slidably positioned within the receiver aperture 25 so that it may traverse the pathway 26. A receiver opening 30 comprised of a pair of slots 32, 33 is formed in an upper surface 21 of the platform 20 tangentially with respect to the pathway 26. By retracting the locking member 40, positioning the stirrup 14 of a crossbow 12 through the receiver opening 30 and re-inserting the locking member 40, the crossbow 12 may be locked into an upright position for use on-the-fly or to aid in setting the crossbow 12 into an armed position.

B. Platform

The present invention will generally be comprised of a base platform 20 as shown in FIG. 1. The platform 20 is utilized as a base when setting a crossbow 12 into an armed position. The platform 20 may also be utilized to act as a base stand for the crossbow 12 when it is not in use so that a hunter may have easy and quick access to a loaded crossbow 12 when using game calling devices, range fingers and the like.

As shown in FIG. 1, the platform 20 will generally be comprised of a free-standing base having an upper surface 21, a lower surface 22, a front end 23 and a rear end 24. While the platform 20 is illustrated as being comprised of an octagonal shape in the exemplary figures, it should be appreciated that various other shapes may be utilized for the platform 20. Thus, the shape and configuration of the platform 20 should not be construed as being limited by the exemplary figures.

Figure 5:
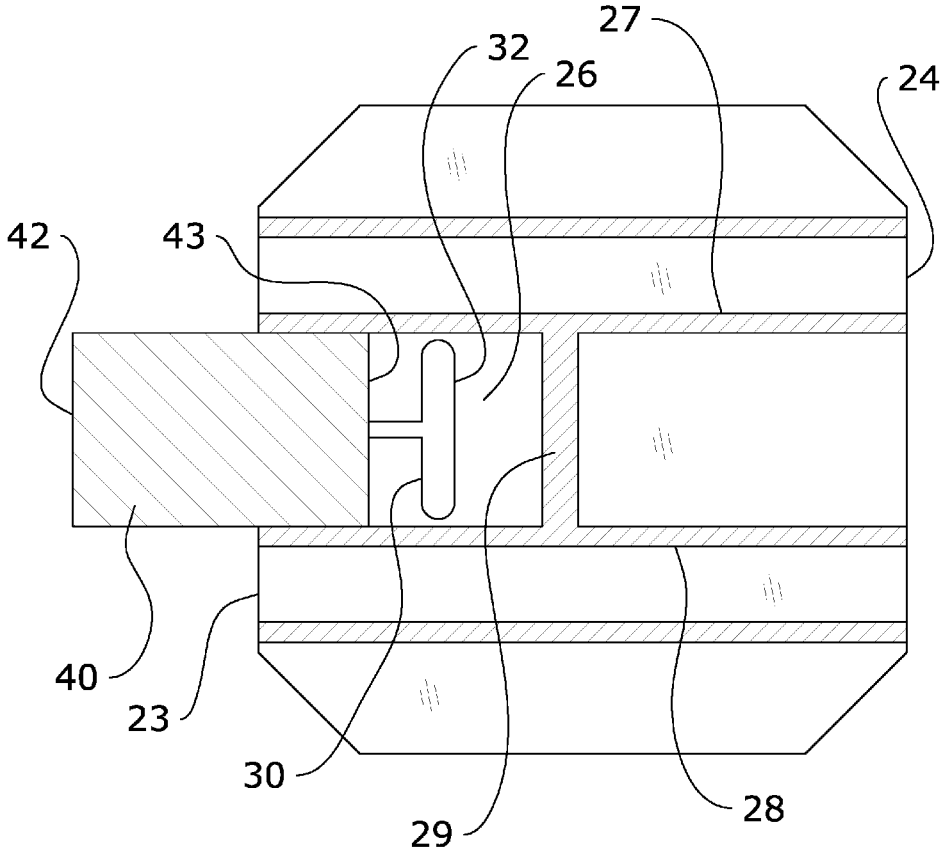
FIG. 5 is a top cutaway view of the present invention.

The platform 20 will generally include a receiver aperture 25 positioned on its front end 23 as shown in FIG. 1. The receiver aperture 25 is comprised of an opening which leads to a pathway 26 extending into the body of the platform 20. The pathway 26 is preferably defined by a first side wall 27, second side wall 28 and end wall 29 as shown in FIG. 5.

The side walls 27, 28 act to guide the locking member 40 of the present invention as it traverses the pathway 26 and the end wall 29 acts as a stopper for the locking member 40 as it is inserted. Thus, in a preferred embodiment, the depth of the distance which the pathway 26 extends into the platform 20 from its front end 23 will be slightly less than the length of the locking member 40. Such a configuration allows a portion of the locking member 40 to extend out of the receiver aperture 25 when the locking member 40 is fully inserted into the pathway 26.

C. Receiver Opening

Figure 4:
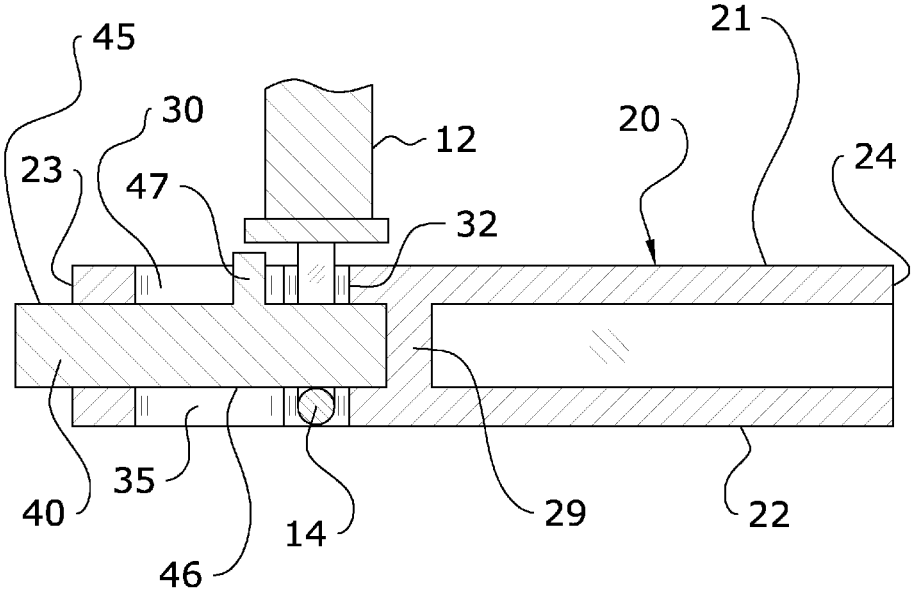
FIG. 4 is a side sectional view of a crossbow positioned within the present invention.

The present invention will generally include a receiver opening 30 adapted to receive a stirrup 14 of a crossbow 12. As shown in FIG. 4, the receiver opening 30 will generally be comprised of a first slot 32 and a second slot 33 formed in the upper surface 21 of the platform 20 adjacent its front end 23, wherein the receiver opening 30 extends through the platform 20 tangential with respect to the pathway 26 and through the pathway 26.

Preferably, the receiver opening 30 will be comprised of a first slot 32 and a second slot 33 extending tangentially in a perpendicular direction from a central point on the first slot 32. The first slot 32 of the receiver opening 30 is utilized to receive the stirrup 14 of a crossbow 12 and the second slot 33 of the receiver opening 30 acts in combination with the stopper 47 of the locking member 40 to prevent the locking member 40 from being completely removed from the receiver aperture 25.

A lower slot 35 will generally be formed in the lower surface 22 of the platform 20 directly underneath the receiver opening 30. The lower slot 35 is adapted to receive the stirrup 14 of a crossbow 12 when inserted through the receiver opening 30 as shown in FIG. 4.

D. Locking Member

The present invention will generally include a locking member 40 which is slidably positioned within the receiver aperture 25 of the platform 20. The locking member 40 will preferably be comprised of a block-like structure having a front end 42, a rear end 43, an upper end 45 and a lower end 46 as shown in FIG. 1. The locking member 40 is utilized to lock the stirrup 14 of a crossbow 12 within the receiver aperture 25 so that it may be set for use.

Figure 2:
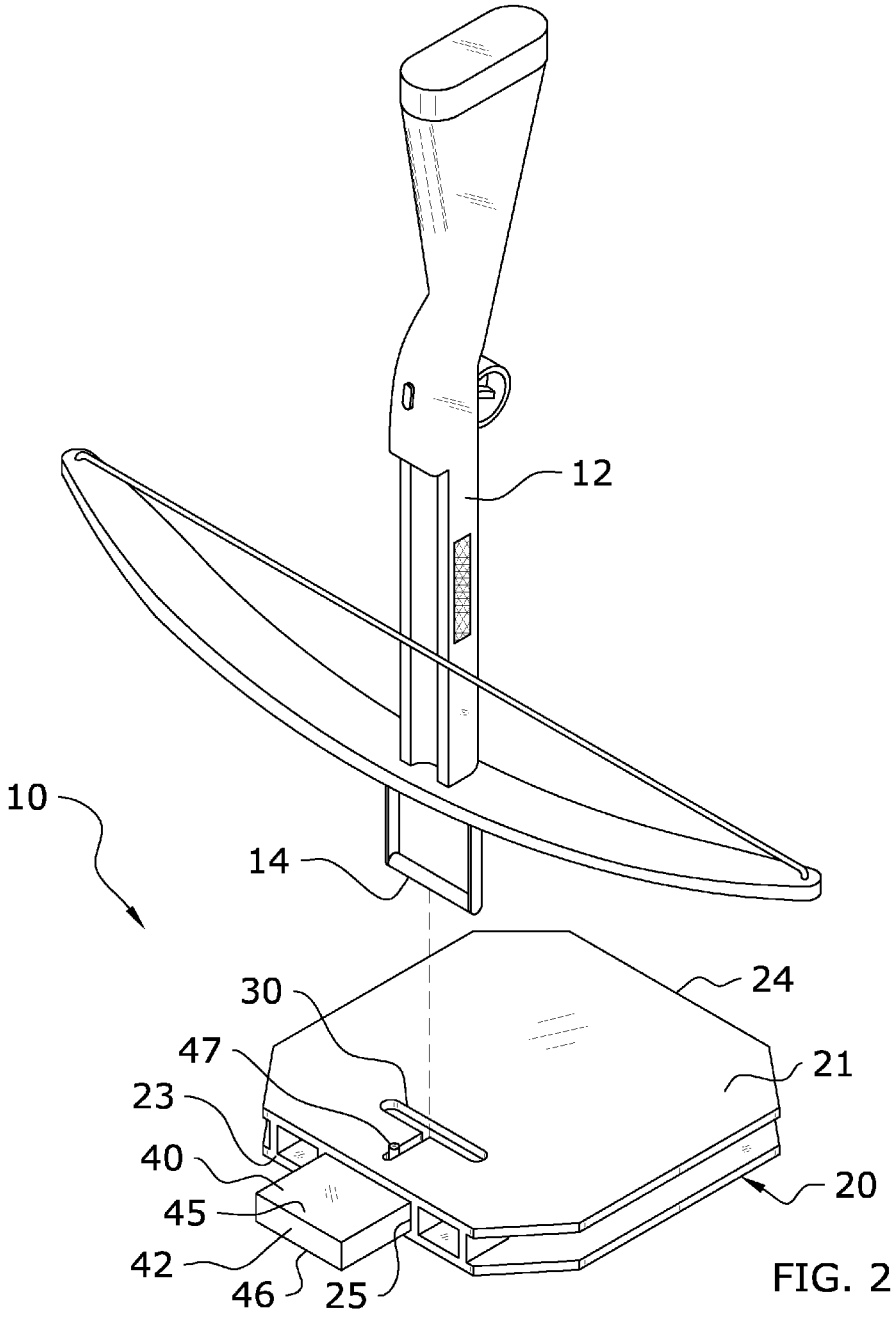
FIG. 2 is an upper perspective view of a crossbow being positioned within the present invention.
Figure 3:
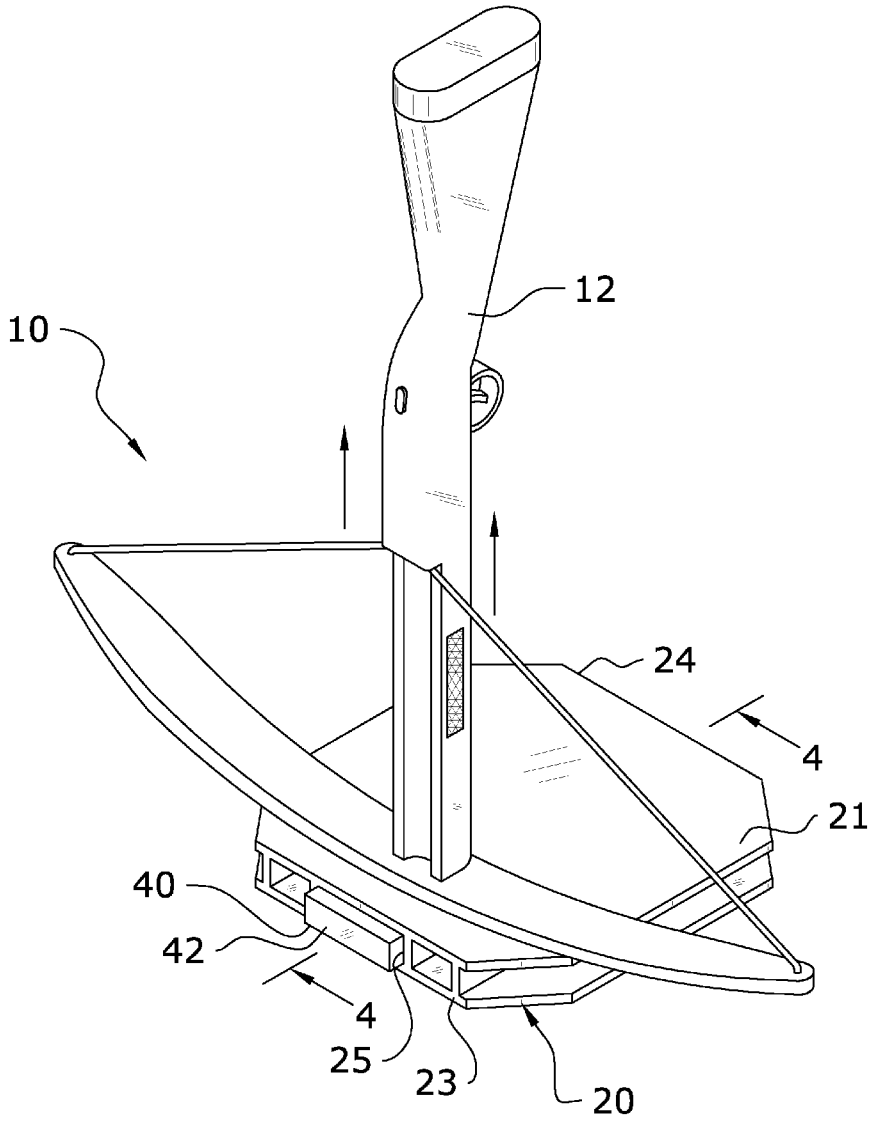
FIG. 3 is an upper perspective view of a crossbow positioned within the present invention.

The locking member 40 is positioned within the receiver aperture 25 in a manner which allows it to slide into and out of the pathway 26 as shown in FIGS. 1 and 2. The locking member 40 may include a stopper 47 positioned on its upper end 45 which extends through the second slot 33 of the receiver opening 30. The stopper 47 may be comprised of a bolt, nut or other device which will act to prevent the locking member 40 from being fully removed from the pathway 26 and receiver aperture 25 of the platform 20 by engaging with the front end of the second slot 33 of the receiver opening 30.

E. Operation of Preferred Embodiment

The present invention is adapted for use in various locations and for various purposes, such as in a tree stand when hunting. The present invention may be utilized to secure a crossbow 12 in an upright position for hands-free operation of sighting or other devices or it may be utilized to assist in setting a crossbow 12 into an armed position.

To set a crossbow 12 with the present invention, the locking member 40 is first partially pulled out through the receiver aperture 25 to clear the pathway 26 and receiver opening 30 of obstruction. The stirrup 14 of the crossbow 12 may then be inserted directly through the receiver opening 30 until the end of the stirrup 14 is positioned within the lower slot 35 in the lower surface 22 of the platform 20.

With the stirrup 14 inserted through the receiver aperture 25, the locking member 40 may be inserted back through the receiver aperture 25 and into the pathway 26. As shown in FIG. 4, the locking member 40 will extend through the opening of the stirrup 14 of the crossbow 12 to lock the crossbow 12 in an upright position within the platform 20. The crossbow 12 may then be set in an armed position by pulling up on the crossbow 12 without the need for positioning a foot or other object in the stirrup 14. When ready, the crossbow 12 may be removed from the platform 20 by pulling out the locking member 40 through the receiver aperture 25 and then lifting the crossbow 12 out of the receiver opening 30.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A crossbow setting device, comprising:

a platform, wherein said platform includes an upper surface and a front end;

a receiver aperture positioned in said front end of said platform;

a pathway extending into said platform from said receiver aperture;

a locking member slidably positioned within said pathway; and a receiver opening positioned in said upper surface of said platform, wherein said receiver opening is adapted to removably receive a stirrup of a crossbow.

2. The crossbow setting device of claim 1, wherein said receiver opening is comprised of a first slot and a second slot.

3. The crossbow setting device of claim 2, wherein said second slot extends perpendicularly and tangentially with respect to said first slot.

4. The crossbow setting device of claim 3, further comprising a stopper positioned on an upper end of said locking member, wherein said stopper extends through said second slot.

5. The crossbow setting device of claim 1, wherein said platform is comprised of an octagonal shape.

6. The crossbow setting device of claim 1, wherein said receiver opening is tangential with respect to said pathway.

7. The crossbow setting device of claim 1, wherein said pathway is defined by a first side wall, a second side wall and an end wall.

8. The crossbow setting device of claim 1, wherein said locking member is comprised of a block structure.

9. The crossbow setting device of claim 1, wherein a rear end of said locking member extends out of said receiver aperture when said locking member is inserted into said pathway.

10. The crossbow setting device of claim 1, further comprising a lower slot formed in a lower surface of said platform.

11. A crossbow setting device, comprising:

a platform, wherein said platform includes an upper surface and a lower surface;

a receiver aperture in said platform;

a pathway extending into said platform from said receiver aperture;

a locking member slidably positioned within said pathway; and a receiver opening positioned in said upper surface of said platform, wherein said receiver opening is comprised of a first slot and a second slot extending tangentially with respect to said first slot, wherein said receiver opening is adapted to removably receive a stirrup of a crossbow.

12. The crossbow setting device of claim 11, wherein said second slot extends perpendicularly with respect to said first slot.

13. The crossbow setting device of claim 11, further comprising a stopper positioned on an upper end of said locking member, wherein said stopper extends through said second slot.

14. The crossbow setting device of claim 11, wherein said receiver opening is tangential with respect to said pathway.

15. The crossbow setting device of claim 11, wherein said pathway is defined by a first side wall, a second side wall and an end wall.

16. The crossbow setting device of claim 11, wherein said locking member is comprised of a block structure.

17. The crossbow setting device of claim 11, wherein a rear end of said locking member extends out of said receiver aperture when said locking member is inserted into said pathway.

18. The crossbow setting device of claim 1, further comprising a lower slot formed in a lower surface of said platform.

19. A crossbow setting device, comprising:

a platform, wherein said platform includes an upper surface and a lower surface;

a receiver aperture formed in a front end of said platform;

a pathway extending into said platform from said receiver aperture, wherein said pathway is defined by a first side wall, a second side wall and an end wall;

a locking member slidably positioned within said pathway, wherein said locking member includes a stopper positioned on its upper end, wherein a rear end of said locking member extends out of said receiver aperture when said locking member is inserted into said pathway; and a receiver opening positioned in said upper surface of said platform, wherein said receiver opening is tangential with respect to said pathway, wherein said receiver opening is comprised of a first slot and a second slot extending tangentially with respect to said first slot, wherein said first slot is adapted to removably receive a stirrup of a crossbow, wherein said stopper extends through said second slot.

20. The crossbow setting device of claim 19, further comprising a lower slot formed in a lower surface of said platform for receiving said stirrup.

* * * * *